United States Patent [19]

Hiesbock

[11] Patent Number: 4,793,817

[45] Date of Patent: Dec. 27, 1988

[54] CONTACT PIN

[75] Inventor: Heinz G. Hiesbock, Modling, Austria

[73] Assignee: Karl Neumayer, Erzeugung und Vertreib von Kabeln, Drahten isolierten Leitungen und Elektromaterial Gesellschaft mit beschrankter Haftung, Gunselsdorf, Austria

[21] Appl. No.: 938,960

[22] Filed: Dec. 8, 1986

Related U.S. Application Data

[63] Continuation-in-part of Ser. No. 783,232, Oct. 2, 1985, abandoned.

[30] Foreign Application Priority Data

Feb. 27, 1985 [AT] Austria ..... 587/85
Jul. 11, 1986 [DE] Fed. Rep. of Germany ..... 3623453

[51] Int. Cl.[4] ..... H01R 13/428
[52] U.S. Cl. ..... 439/82; 439/751
[58] Field of Search ..... 439/82, 743, 751, 825, 439/826, 827, 870, 873

[56] References Cited

U.S. PATENT DOCUMENTS

| | | | |
|---|---|---|---|
| 4,176,448 | 12/1979 | Zahn et al. | 29/626 |
| 4,223,970 | 9/1980 | Walter | 339/220 R |
| 4,274,699 | 6/1981 | Keim | 339/220 R |
| 4,318,964 | 3/1982 | Zahn et al. | 428/572 |
| 4,475,780 | 10/1984 | Walter et al. | 339/221 R |
| 4,586,778 | 5/1986 | Walter et al. | 339/221 R |

FOREIGN PATENT DOCUMENTS

| | | |
|---|---|---|
| 0005356 | 11/1979 | European Pat. Off. . |
| 0077941 | 5/1983 | European Pat. Off. . |
| 0102786 | 3/1984 | European Pat. Off. . |
| 3220781 | 12/1983 | Fed. Rep. of Germany . |
| 275708 | 8/1927 | United Kingdom . |
| 278359 | 9/1927 | United Kingdom . |
| 278225 | 10/1927 | United Kingdom . |
| 411383 | 6/1934 | United Kingdom . |
| 1149332 | 4/1969 | United Kingdom . |
| 1580773 | 12/1980 | United Kingdom . |

*Primary Examiner*—Gil Weidenfeld
*Assistant Examiner*—Gary F. Paumen
*Attorney, Agent, or Firm*—Fleit, Jacobson, Cohn & Price

[57] ABSTRACT

Contact pin for fastening in a perforation, particularly for pressing into plated-through holes in a printed circuit board, with a fastening section exhibiting an overwidth and a doubly symmetrical cross-section and exhibiting two mutually mobile lateral parts mutually distanced by two mutually diametrally opposite grooves extending in the longitudinal direction of the pin, while the lateral parts exhibit on their outsides a curvature which corresponds to the curvature of the cross-section of the perforation, particularly to the curvature of the printed circuit board holes provided to receive the pin, wherein the outsides of the lateral parts which come into contact with the inside of the printed circuit board holes together exhibit a circumferential extension between 70% and 90% of the circumferential extension of the inside of the printed circuit board hole and method for producing a contact pin whereby wire, preferably square wire, is drawn off from a wire coil and deformation thereof to overwidth with development of the curvature and of a contact circumferential extension of 70% to 90% of the circumferential extension of the insides of the printed circuit board hole is achieved in continuous sequence in conformity with the longitudinal dimensions of a contact pin.

16 Claims, 5 Drawing Sheets

CONTACT PIN

This application is a continuation-in-part of U.S. patent application Ser. No. 783,232, filed Oct. 2, 1985, now abandoned.

The invention relates to a contact pin for fastening in a perforation, particularly for pressing into plated-through holes in a printed circuit board with a fastening section exhibiting an overwidth and a doubly symmetrical cross-section and exhibiting two mutually mobile lateral parts mutually distanced by two mutually diametrally opposite grooves extending in the longitudinal direction of the pin, whilst the lateral parts exhibit on their outsides a curvature which corresponds to the curvature of the cross-section of the perforation, particularly to the curvature of the printed circuit board holes provided to receive the pin.

Contact pins of this type have become known through EP-A1 0,005,356. One of the serious disadvantages of these known contact pins is their relatively small surface with which they contact the wall of the printed circuit board hole in the inserted state. This is also, inter alia, the reason why these pins tend to increased creep phenomena, whereby the fit of the pin loosens in the course of time. Nor can this be prevented simply by increasing the pressure when inserting into the hole, because any such increase is subject to very narrow limits which are dictated by the only moderate mechanical load capacity of the holes in the generally thin printed circuit boards, which tend to tear under high contact pressures.

SUMMARY OF THE INVENTION

The object of the invention is to avoid these disadvantages, which is achieved in a contact pin of the type initially mentioned, in that the outsides of the lateral parts which come into contact with the inside of the printed circuit board holes together exhibit a circumferential extension between 70% and 90% of the circumferential extension of the inside of the printed circuit board hole. This measure achieves a large contact surface, and therefore also higher reliability of contact, whereby the gas-tightness of the connection is also improved, but the tendency to creep phenomena is also reduced simultaneously.

A particularly advantageous embodiment of the invention may consist in that the grooves which extend in the longitudinal direction of the pin exhibit a trapezoidal cross-section. This produces the substantial advantage that the common floor of the grooves which remains after the deformation or after a further machining, if any, exhibits an equal thickness at every point. This prevents :he occurrence of an upsetting of the material, and hence a plastic deformation of the latter, in this region upon the insertion of the contact pin, whereby the pin loses its resilience in these regions. This is the case, for example, of the vat-shaped grooves of the EP-A1 0,005,356 mentioned initially.

In the case of this embodiment of the invention, a particularly advantageous further development may consist in that the two boundary walls of the longitudinal grooves which are mutually inclined enclose between them an angle smaller than 60°, particularly an angle 20° to 30°. The transverse stability of the pin in particular can be improved by this means.

Another embodiment of the invention may consist in that the grooves which extend in the longitudinal direction of the pin exhibit a rectangular cross-section, optionally with lateral faces slightly inclined, at a mutual angle up to 5°, for example. Such a pin is characterized by a particularly large contact surface on the inside of the printed circuit board oole whilst simultaneously ensuring satisfactory resilience of the pin.

The conditions of resilience for the pin according the invention may be ensured in a particularly advantageous manner in that the two lateral parts are mutually separated by a slit-shaped perforation oriented in the longitudinal direction of the contact pin.

In another embodiment of a contact pin according the the invention, in which the two lateral parts are mutually connected by a web oriented in a symmetry dividing plane, the resilience can be ensured in that the web itself is of resiliently deformable construction.

This can be achieved in a particularly advantageous manner if, as a further development of the invention, the total material volume of the web equals 4% to 10% of the total volume of the fastening section.

According to yet another exemplary embodiment of the invention, this web may, in manner known per se, be formed by the common floor of the two mutually diametrally opposite gro° ves which extend in the longitudinal direction of the pin.

Particularly advantageous resilience characteristics are created if, according to yet another embodiment of the invention, the contact pin in the uninserted state exhibits an outside diameter which exceeds the inside diameter of the printed circuit board hole by a value 5% to 25% of the width of the web or the width of the slit-shaped perforation. Extremely high symmetry of the spring characteristics is achieved by this means. In this case two lateral parts of the fastening section, approximately circular segment-shaped in cross-section, are produced with a high deformation resistance which results in a firm contact fit which scarcely varies even in the course of time and ensures a high retaining force without the need to exert particularly high insertion pressures which may lead :o damage to the board receiving the pins.

The electrical contact of this contact fit may be further improved if, as a further development of the invention, the longitudinal grooves are filled with an electrically conductive paste; the electrical contact can be optimized in a simple manner by this measure.

Another object of the invention is to propose a method of producing the contact pins according to the invention. It is therefore proposed according to the invention that wire preferably square wire, is drawn off from a wire coil, and that the deformation thereof to overwidth with development of the curvature and of a contact circumferential extension (*2b*) of 70%–90% of the circumferential extension of the insides of the printed circuit board hole is achieved in continuous sequence in conformity with the longitudinal dimensions of a contact pin.

As a further development of the method according to the invention, a preferred procedure may be that diametrally opposite grooves oriented in the longitudinal direction are embossed into the fastening section which exhibits overwidth, preferably simultaneously with the deformation to overwidth. This web formed by the common floor of the grooves may than be constructed with the slit-shaped perforation.

Such a method of continuous production of contact pins according to the invention is particularly efficient, and the tools required for the purpose have low production costs. The slit-shaped perforation can be produced precisely by the exertion of only slight forces, s that a constant quality of the contact pins is ensured whilst producing spring elements all of the same thickness.

In this case it may further be provided that the slit-shaped porforations are widened after their production. However, it is also possible to produce the pins with a wider slit-shaped perforation, which will be practised preferably if the contact pin, when it is embossed in the region of the slit-shaped perforation, is produced with a diameter which exceeds the diameter of the hole provided to receive the pin.

BRIEF DESCRIPTION OF THE DRAWINGS

The invention will be explained more fully with reference to the drawings. In the drawings.

DESCRIPTION OF THE PREFERRED EMBODIMENTS

Figure 1A:
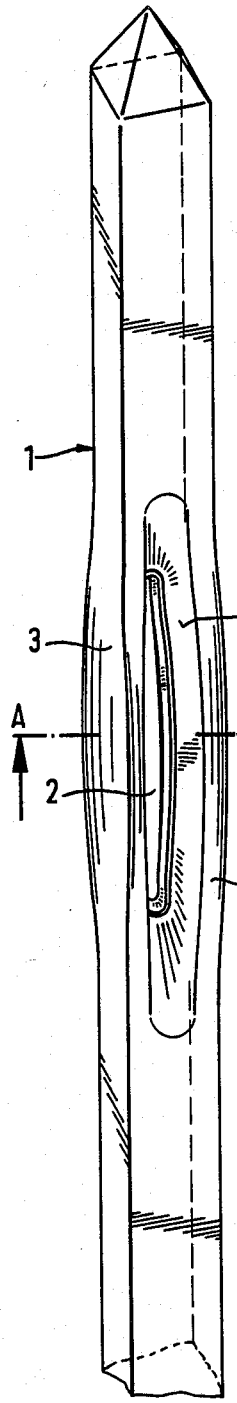
FIGS. 1*a–d* show a contact pin according to the invention.
Figure 1B:
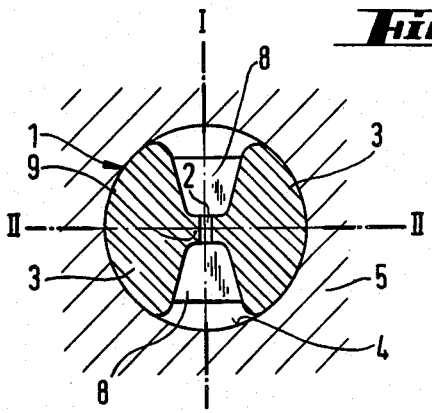
Figure 1C:
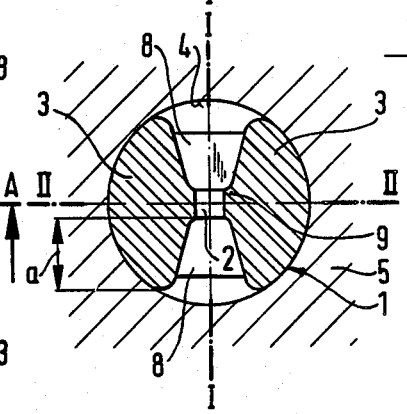
Figure 1D:
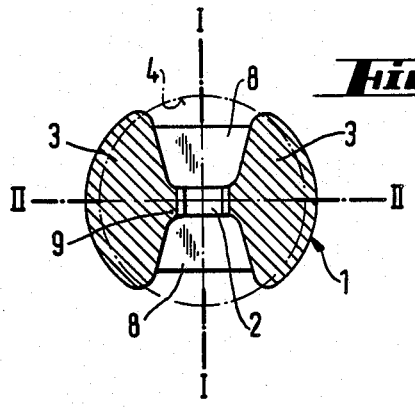
Figure 2A:
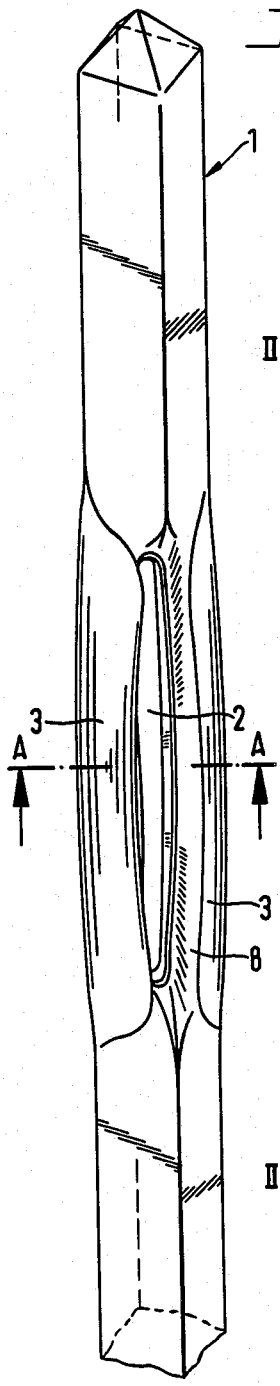
FIGS. 2*a–d* show a variant contact pin according to the invention.
Figure 2B:
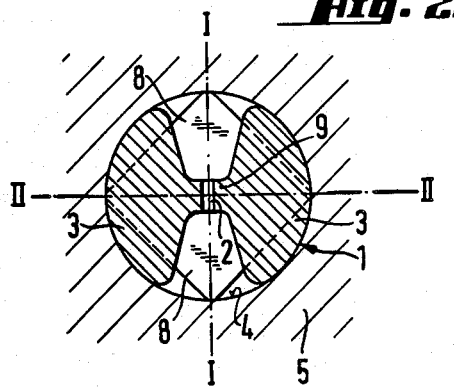
Figure 2C:
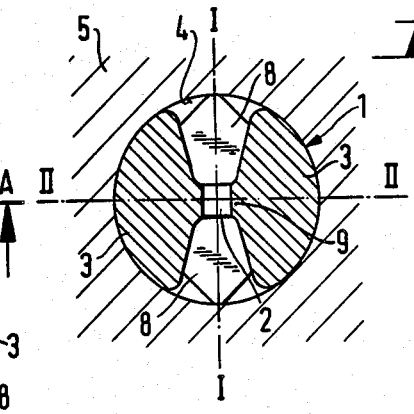
Figure 2D:
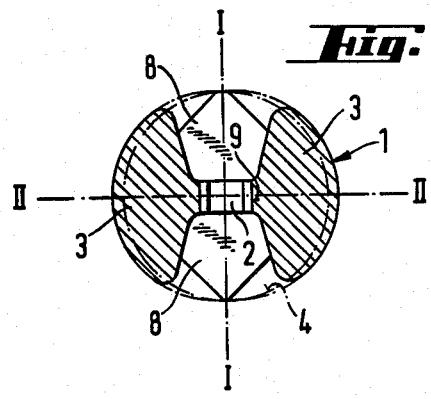

FIGS. 1*a–*1*d* illustrate a contact pin 1 according to the invention which has been produced from a solid wire material of square cross-section. Here, FIG. 1*a* shows the contact pin in a partial perspective view, FIG. 1*b* and FIG. 1*c* show the contact pin inserted into a printed circuit board hole in cross-section along the line AA of FIG. 1*a*, whilst the contact pins according to FIG. 1*b* and FIG. 1*c* have each been produced according to a different variant of the method, and FIG. 1*d* shows, likewise in cross-section along the line AA, the contact pin according to FIG. 1*c* in the uninserted state.

The contact pin 1 is constructed in the fastening section with two lateral parts 3 and with a slit-shaped perforation 2 located between the latter. The outward pointing total circumferential extension 2*b* of the two lateral parts 3, which in the inserted state of the contact pin is in contact with the inside of the printed circuit board hole, equals 70%–90% of the circumferential extension of the inside of the printed circuit board hole. In the uninserted state the fastening section-exhibits an overwidth c, which means that its diameter is greater than the inside diameter of the hole intended to receive it in the printed circuit board 5. The dimensioning of the overwidth c will be dealt with in further detail below.

The slit-shaped perforation 2 of the contact pin 1 is constructed in the common floor of two mutually diametrally opposite longitudinal grooves 8 produced by embossing, and the longitudinal grooves 8 have a depth a. Consequently the contact pin exhibits in the fastening section a doubly symmetrical cross-section, that is to say symmetry prevails both with regard to the axes I—I and also with regard to the axes II—II. The longitudinal grooves 8 each have a trapezoidal cross-section, whilst the two boundary walls of the trapezium which are oriented mutually inclined enclose a mutual angle 0 which is smaller than 60°. It has been found particularly advantageous if this angle is between 20° and 30°.

As a variant of this embodiment, the groove cross-section may also—although not shown—have a rectangular cross-section in which the mutually opposite sides of the rectangle are optionally slightly mutually inclined, at an angle up to 5° for example, to facilitate the release of the counterbore.

In principle, the embossing is effected in a mould or die in which the curvature of the internal mould wall corresponds to the curvature of the inner wall of the printed circuit board hole Now the inside diameter or the inside width of this mould may be chosen in different ways. Either the inside diameter of the mould corresponds exactly to the diameter of the receiving bore 4 in the printed circuit boar 5, in which case after the embossing and production of the slit-shaped perforation 2 in the common floor of the two longitudinal grooves 8, after release from the mould, the slit-shaped perforation 2 must be widened by the amount e A contact pin produced in this manner is illustrated in the inserted state in FIG. 1*c*. Alternatively, however, the embossing and slitting may also be performed in a mould, the inside diameter of which is already greater by the amount c than the diameter of the receiving hole 4 in the printed circuit board 5, so that a subsequent widening of the slit-shaped perforation 2 is made superfluous A contact pin produced in this manner is illustrated in the inserte state in FIG. 1*b*. As FIG. 1*b* shows, the width of the slit-shaped perforation 2 increases in the :inserted state; the spring action is obtained by the overwidth of the contact pin diameter, in the insertion region, which is dictated by the production in the mould, and is therefore obtained at the outset.

FIGS. 2*a–d* show an embodiment of a contact pin 1 priduced in conformity with FIGS. 1*a–d* in which the embossing and slitting is effected across the edges of the pin produced from square material.

FIGS. 3*a–d* illustrate a contact pin 1 which has been produced from a round material in accordance with the steps of the method explained in conjunction with FIGS. 1*a–d*. Technically, FIGS. 2*b–d* and 3*b–d* correspond to FIGS. 1*b–d*. Particularly, again in these exemplary embodiments the curvature of the outside of the contact pin cross-section in the fastening section corresponds to the curvature of the inside wall of the hole 4 receiving the pin, and the pin cross-section is doubly symmetrical.

Figure 3A:
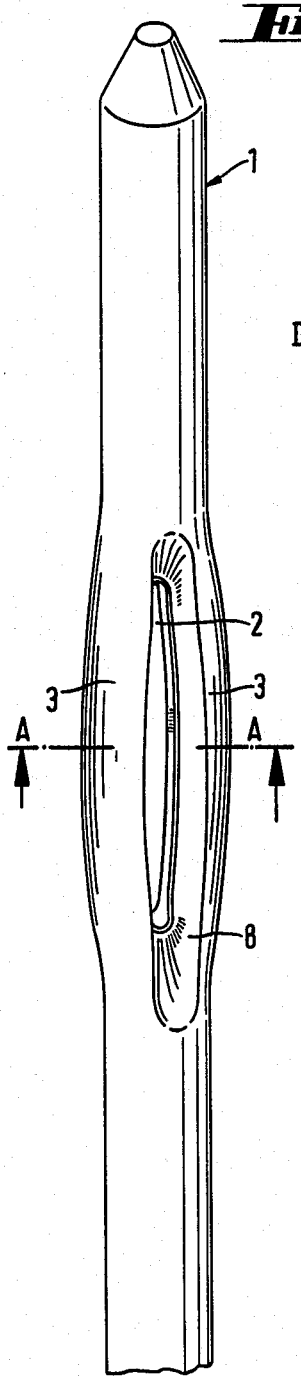
FIGS. 3*a–d* show a further embodiment of a contact pin according to the invention, FIGS. 4*a* and *b* again show another embodiment of a contact pin according to the invention.
Figure 3B:
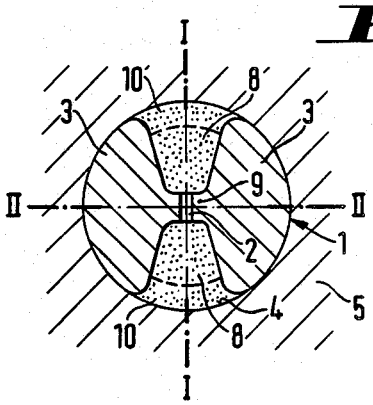
Figure 3C:
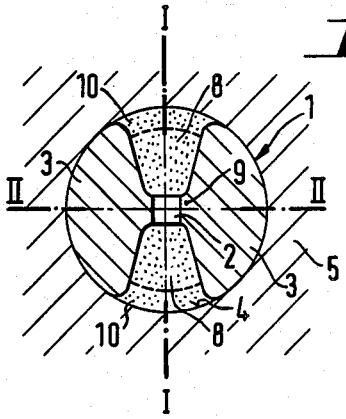
Figure 3D:
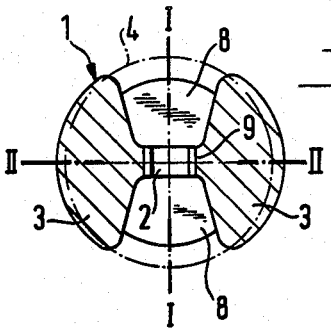

In FIGS. 3*b* and 3*c* the longitudinal groove 8 is filled as far as the inner edge of the printed circuit board hole with a conductive paste 10, which is indicated by dotted lines. This may also be effected in the same manner in the case of embodiments according to FIGS. 1 and 2.

The common floor 9 of the two longitudinal grooves, which is oriented as a web in a diametral plane, is common to all the embodiments of the pins 1 according to the invention. Symmetrical construction of the contact pin according to the invention ensures a uniform contact pressure distributed over a large region of the wall of the hole.

By virtue of the trapezoidal or rectangular cross-section, the web has a uniform thickness over its total extension, which prevents the possibility of upsetting in the case of deformation, which might give rise to plastic deformations. These plastic deformations mean that during insertion an arbitrary deformation occurs which is different for every pin, so that the contacts between pin and printed circuit board vary from one inserted pin to another and different transfer resistance: exist every time, which is the case with the known pins of the type discussed initially. The avoidance of these problems constitutes an essential advantage of the subject-matter of the invention.

Figure 4A:
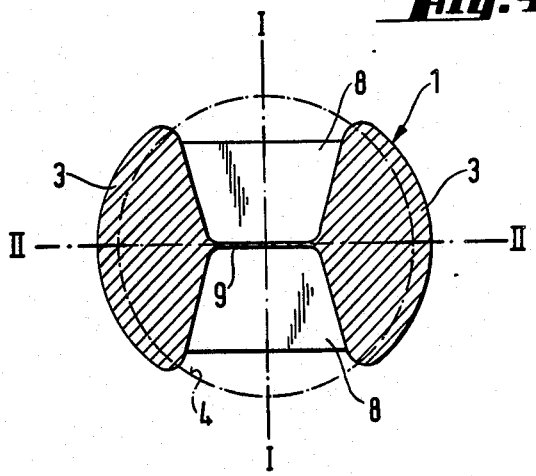
Figure 4B:
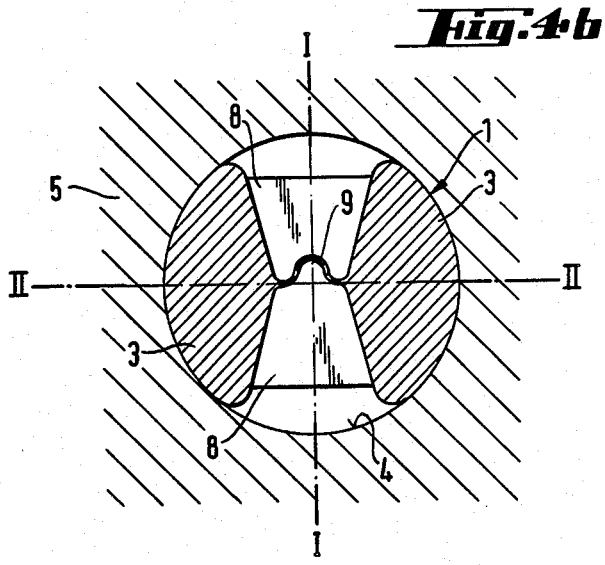
Figure 5:
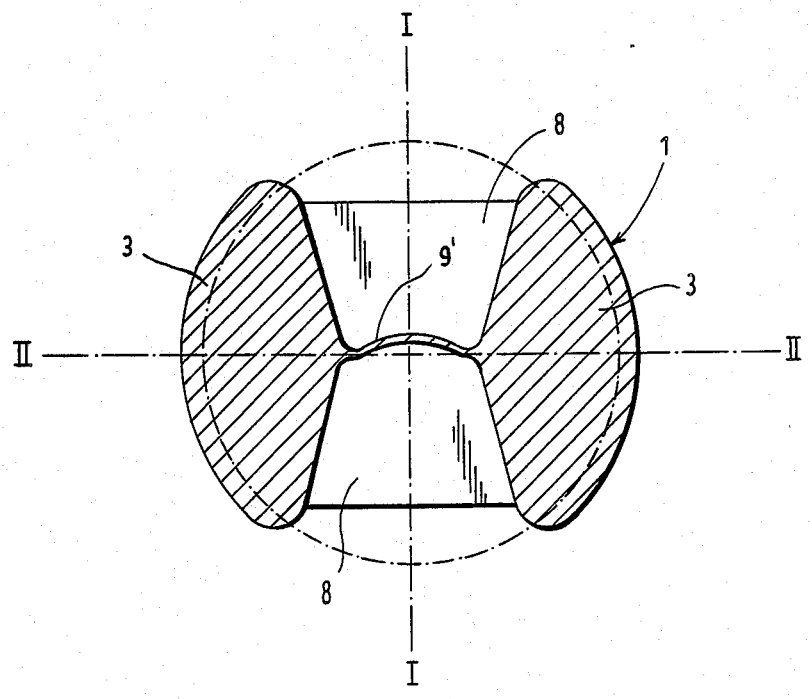
FIG. 5 shows a variant of the embodiment of FIG. 4.

However, the invention is not restricted to embodiments which necessarily exhibit a slit-shaped perforation 2. As FIGS. 4*a* and *b* show in cross-section, the web may be left as such. Particularly if the total material volume of the web equals 4% to 10% of the total volume of the fastening section, the web is so thin that it can be deformed resiliently during the insertion of the pin without impairing the remaining characteristics of the contact pin. This resilient deformability of the web may be favoured still more in that the web is as is the case of the web 9' according to FIG. 5. In FIG. 4*a*, which shows the contact pin 1 in cross-section in the uninserted state, and in FIG. 4*b*, which shows the inserted state, those parts which correspond to the contact pins of the other figures are designated by the same reference numerals.

In all the above-described exemplary embodiments, the overwidth c may be chosen so that it equals 5% to 25% of the width of the web or of the width of the slit-shaped perforation.

As already mentioned, the production of the above-described contact pins, which are by ho means limited to a specific wire cross-section, may be effected continuously starting from a continuous wire coil. The production of the contact pins shown in FIGS. 1–4 may conveniently be effected in that the embossing of the longitudinal grooves occurs initially in an embossing station. Then, in a second station, the slit-shaped perforations 2 are made for the pins according to FIGS. 1 to 3, and they are optionally also widened. The feed from one :station to the next corresponds to the production of one pin length so as to ensure continuity.

However, the invention is not restricted to this; it is likewise possible to execute the embossing and making of the slit-shaped perforations and optionally also the widening simultaneously or consecutively in one station.

After production is complete the pins may be cut to length and fed loose or strapped t further processing or to use. Alternatively, the wire strand constructed with the contact pins according to the invention may also be constructed with intended breakage points, for example notches, constrictions, et cetera, at intervals corresponding to the contact pin lengths, so that equipping of the printed circuit boards may be effected from the continuous wire strand.

The invention is furthermore not restricted to the production of the contact pins from a wire material of specific cross-section. In addition to the materials of a square wire or round wire illustrated in the drawings, flat wires, hexagonal wires et cetera may also be used as starting materials for the pin production. Other modifications of detail can also be made within the scope of the invention.

I claim:

1. A contact pin for fastening in a perforation, particularly for pressing into a plated-through hole in a printed circuit board, said contact pin comprising:

a fastening section including a cross-section having two axes of symmetry and including two mutually mobile lateral parts mutually distanced by two mutually diametrically opposite grooves extending in the longitudinal direction of the pin, and said lateral parts include a peripheral curvature corresponding to the curvature of the cross-section of the perforation, particularly to the curvature of the printed circuit board hole provided to receive the pin, and the surfaces of said lateral parts adapted to be in contact with the inside of the printed circuit board hole together exhibit a circumferential distance equal to between 70% to 90% of the circumferential distance of the inside of the printed circuit board hole and two boundary walls of each of the longitudinal grooves are mutually inclined and enclose between them an angle smaller than 60?, said two lateral parts being mutually separated by a slit-shaped perforation oriented in the longitudinal direction of the contact pin.

2. A contact pin according to claim 1, wherein said grooves extend in the longitudinal direction of the pin and include a trapezoidal cross-section.

3. A contact pin according to claim 1, wherein said grooves extend in the longitudinal direction of the pin, said grooves having a cross-section with lateral faces inclined at a mutual angle of up to 5°.

4. A contact pin according to claim 1, wherein a web extends between said two lateral parts and includes said slit-shaped perforation.

5. A contact pin according to claim 1, wherein said longitudinal grooves are filled with electrically conductive paste.

6. A contact pin according to claim 1, wherein prior to insertion in the printed circuit board hole, said contact pin exhibits an outside diameter which exceeds the inside diameter of the printed circuit board hole by a value which equals from 5% to 25% of one of the width of the web and the width of the slit-shaped perforation.

7. A contact pin for fastening in a perforation, particularly for pressing into a plated-through hole in a printed circuit board, said contact pin comprising:

a fastening section including a cross-section having two axes of symmetry and including two mutually mobile lateral parts mutually distanced by two mutually diametrically opposite grooves extending in the longitudinal direction of the pin, and said lateral parts include a peripheral curvature corresponding to the curvature of the cross-section of the perforation, particularly to the curvature of the printed circuit board hole provided to receive the pin, and the surfaces of said lateral parts adapted to be in contact with the inside of the printed circuit board holes together exhibit a circumferential distance equal to between 70% to 90% of the circumferential distance of the inside of the printed circuit board hole and two boundary walls of the longitudinal grooves are mutually inclined and enclose between them an angle smaller than 60°, said two lateral parts being mutually connected by a web oriented in a plane of symmetry of the contact pin, and said web being of resiliently deformable construction.

8. A contact pin according to claim 7, wherein said web is preshaped.

9. A contact pin according to claim 7, wherein the total material volume of the web equals 4% to 10% of the total volume of the fastening section.

10. A contact pin according to claim 7, wherein said web is a common floor of said two mutually diametrally opposite grooves extending in the longitudinal direction of the pin.

11. A contact pin for fastening in a perforation, particularly for pressing into a plated-through hole in a printed circuit board, said contact pin comprising:

a fastening section including a cross-section having two axes of symmetry and including two mutually mobile lateral parts mutually distanced by two mutually diametrically opposite grooves extending in the longitudinal direction of the pin, and said lateral parts include a peripheral curvature corresponding to the curvature of the cross-section of the perforation, particularly to the curvature of the printed circuit board hole provided to receive the pin, and the surfaces of said lateral parts adapted to be in contact with the inside of the printed circuit board hole together exhibit a circumferential distance equal to between 70% and 90% of the circumferential distance of the inside of the printed circuit board hole and said two lateral parts are mutually separated by a slit-shaped perforation oriented in the longitudinal direction of the contact pin.

12. A contact pin according to claim 11, wherein said grooves extend in the longitudinal direction of the pin and include a trapezoidal cross-section.

13. A contact pin according to claim 12, two boundary walls of the longitudinal grooves are mutually inclined and enclose between them an angle smaller than 60°.

14. A contact pin according to claim 11, wherein said grooves extend in the longitudinal direction of the pin, said grooves having a cross-section with lateral faces inclined at a mutual angle of up to 5°.

15. A contact pin according to claim 11, wherein the total material volume of the web equals 4% to 10% of the total volume of the fastening section.

16. A contact pin according to claim 11, wherein prior to insertion in the printed circuit board hole, said contact pin exhibits an outside diameter which exceeds the inside diameter of the printed circuit board hole by a value which equals from 5% to 25% of one of the width of the web and the width of the slit-shaped perforation.

* * * * *